US011905102B2

(12) United States Patent
Lavelanet et al.

(10) Patent No.: US 11,905,102 B2
(45) Date of Patent: Feb. 20, 2024

(54) CARTRIDGE, METHOD OF MAKING A CARTRIDGE AND METHOD OF USING A CARTRIDGE

(71) Applicant: Sulzer Mixpac AG, Haag (CH)

(72) Inventors: Richard Lavelanet, Balgach (CH); Ralf Grünenfelder, Wangs (CH); Tobias Bodenmüller, Eriskirch (DE)

(73) Assignee: MEDMIX SWITZERLAND AG, Haag (CH)

( * ) Notice: Subject to any disclaimer, the term of this patent is extended or adjusted under 35 U.S.C. 154(b) by 0 days.

(21) Appl. No.: 17/281,721

(22) PCT Filed: Sep. 17, 2019

(86) PCT No.: PCT/EP2019/074790
§ 371 (c)(1),
(2) Date: Mar. 31, 2021

(87) PCT Pub. No.: WO2020/069848
PCT Pub. Date: Apr. 9, 2020

(65) Prior Publication Data

US 2021/0394996 A1 Dec. 23, 2021

(30) Foreign Application Priority Data

Oct. 2, 2018 (EP) ..... 18198298

(51) Int. Cl.
*B65D 83/00* (2006.01)

(52) U.S. Cl.
CPC ..... *B65D 83/0072* (2013.01); *B65D 83/0005* (2013.01)

(58) Field of Classification Search
CPC ..... B65D 83/0072; B65D 47/2031
USPC ..... 222/95
See application file for complete search history.

(56) References Cited

U.S. PATENT DOCUMENTS

| | | | |
|---|---|---|---|
| 4,846,373 A | 7/1989 | Penn et al. | |
| 5,297,697 A | 3/1994 | Boring | |
| 6,132,395 A | 10/2000 | Landau et al. | |
| 8,596,499 B2 | 12/2013 | Vogt et al. | |
| 8,657,141 B2 * | 2/2014 | Habibi-Naini | B05C 17/00553 220/254.1 |

(Continued)

FOREIGN PATENT DOCUMENTS

| | | |
|---|---|---|
| DE | 39 37 295 A1 | 5/1991 |
| DE | 10 2006 001 056 A1 | 7/2007 |

(Continued)

OTHER PUBLICATIONS

Machine translation of EP-2743200.*

(Continued)

*Primary Examiner* — Jeremy Carroll
(74) *Attorney, Agent, or Firm* — GLOBAL IP COUNSELORS, LLP

(57) ABSTRACT

A cartridge for an adhesive or a coating, the cartridge including a head part having an outlet, the head part being integrally formed with a cartridge wall. The outlet has one, two or more outlet passages formed therein. A valve is disposed in each one of the one, two or more outlet passages, with the valve being axially and radially fixed in position relative to the head part at a peripheral portion of the valve.

28 Claims, 7 Drawing Sheets

(56) References Cited

U.S. PATENT DOCUMENTS

| | | | | |
|---|---|---|---|---|
| 2010/0193516 | A1* | 8/2010 | La | B65D 47/2031 220/229 |
| 2011/0272434 | A1 | 11/2011 | Vogt et al. | |
| 2012/0248058 | A1* | 10/2012 | Habibi-Naini | B65D 1/0238 215/45 |
| 2014/0224356 | A1* | 8/2014 | Hatton | B65D 47/2031 137/522 |
| 2014/0263436 | A1* | 9/2014 | Gelov | B65D 35/46 53/410 |
| 2016/0023818 | A1* | 1/2016 | Gelov | B65D 35/04 220/254.1 |
| 2016/0288158 | A1 | 10/2016 | Hiemer | |
| 2017/0043094 | A1 | 2/2017 | Johansen et al. | |
| 2017/0129659 | A1* | 5/2017 | Spiegelhoff | A45D 34/00 |

FOREIGN PATENT DOCUMENTS

| | | | | |
|---|---|---|---|---|
| DE | 10 2009 007 116 | A1 | 8/2010 | |
| EP | 2 743 200 | A1 | 6/2014 | |
| EP | 2743200 | A1 * | 6/2014 | B65D 47/2031 |
| EP | 2 781 253 | A1 | 9/2014 | |
| WO | WO-2013056872 | A1 * | 4/2013 | B05C 17/00553 |
| WO | 2016/127036 | A1 | 8/2016 | |

OTHER PUBLICATIONS

Machine translation of WO-2013056872.*

International Search Report dated Dec. 18, 2019 in corresponding International Patent Application No. PCT/EP2019/074790, filed Sep. 17, 2019.

* cited by examiner

CARTRIDGE, METHOD OF MAKING A CARTRIDGE AND METHOD OF USING A CARTRIDGE

CROSS-REFERENCE TO RELATED APPLICATIONS

This application is a U.S. National Stage application of International Application No. PCT/EP2019/074790, filed Sep. 17, 2019, which claims priority to European Patent Application No. 18198298.4, filed Oct. 2, 2018, the contents of each of which are hereby incorporated herein by reference.

BACKGROUND

Field of the Invention

The present invention relates to a cartridge for an adhesive or a coating, the cartridge comprising a head part having an outlet, wherein the outlet has one, two or more outlet passages formed therein, wherein a valve is provided in each one of the one, two or more outlet passages. The invention further relates to a method of making such a cartridge, and to a method of using such a cartridge.

Background Information

Conventional cartridges, in particular two component cartridges, are used to dispense multi-component material. Such multi-component material is used in a plethora of fields of applications ranging from industrial applications, such as the use of adhesives to bond structural components one to another, or as coatings for buildings or vehicles, to medical and dental applications. The multi-component material is, for example, a two-component adhesive comprising a filler material and a hardener. Multi-component cartridges are available with various ratios of filling, also known as mixing ratios, for example at mixing ratios of 1:1, 2:1, 4:1, 10:1 etc.

By way of example such a cartridge is disclosed in EP 2 781 253 A1. Further prior art can be found in EP 2 743 200 A1.

Since the producer of the cartridge does not necessarily produce the multi-component material stored within the coaxial cartridge, empty coaxial cartridges are frequently supplied to the producer of the multi-component material. The producer of the multi-component material then fills the cartridges with the desired multi-component material. On filling the cartridges these can either be front or rear filled.

SUMMARY

When front-filling the cartridges, filling adapters are inserted into the passages of the outlet and multi-component material is introduced into the respective cartridge via the filling adapter. When removing the filling adapter some of the multi-component material may drip from ends of the filling adapter and can thereby contaminate the passage of the cartridge.

Moreover, when using the cartridge, a pressure is applied to the multi-component materials stored in the cartridge via a piston in order to dispense the multi-component materials. When the pressure on the piston is released, the pressure on the multi-component materials stored in the cartridge is not always instantaneously released which—undesirably—can also cause further multi-component materials to be moved out of the cartridge and dispensed via the outlet passages and cause contamination within the outlet passages. Moreover, when dispensing material from a cartridge the less viscous of the two-components may exit the cartridge first and cause an off-ratio to be present between the components to be dispensed, thereby reducing the mixing quality due to a too high a fraction of the low viscosity material being mixed with the high viscosity material, this is highly undesirable.

Since the contamination in the outlet passages can result in a degradation of the materials stored in the multi-component cartridge this is not desirable.

For this reason it is an object of the invention to provide a cartridge by which a possible contamination can be avoided in the outlet passages. It is a further object of the present invention to reduce an off-ratio between the components to be dispensed from a multi-component material. It is a further object of the invention to provide a cartridge that can be produced in a facile and cost effective manner.

This object is satisfied by a cartridge having the features disclosed herein.

Such a cartridge is generally configured for use with adhesives or coatings, such as paint, and comprises a head part having an outlet, the head part being integrally formed with a cartridge wall, wherein the outlet has one, two or more outlet passages formed therein, wherein a valve is disposed in at least one, preferably in each, of the one, two or more outlet passages, with the valve being axially and radially fixed in position relative to the head part at a peripheral portion of the valve.

By arranging a valve that is fixed in position within each of the outlet passages one can avoid multi-component from leaving the cartridge after a dispensing action has taken place and thereby minimize the contamination present in the outlet passages and hence ensure a lifetime of components present within the cartridge.

Moreover, when front filling the cartridge, the valve can also avoid cross-contamination from taking place when removing the filling adapter, on the one hand, due to the fact that the valve avoids multi-component material from exiting the cartridge. On the other hand, the valve also acts as a kind of scraper means or device that can remove any material that may possibly be present thereon such that no drops of material can drop from the filling material on a removal of the filling adapter.

Similarly when installing or removing a mixer at the outlet, the valve can avoid drops from forming at the mixer that may also drop in an undesirable manner from the mixer and cause cross contamination.

The provision of a valve in the outlet passage also ensures that the valve is placed within a part of the cartridge that is simpler to manufacture and hence leads to a reduction in the cost of producing such a cartridge.

By forming a valve in the outlet passages of a cartridge one provides the cartridge with a barrier that in particular avoid fluids having a lower viscosity from escaping the cartridge in an unwanted manner.

By fixing the valve axially and radially within the outlet passage the valve only comprises its flaps as moveable parts, but the remainder of the valve is fixed in its position.

The presence of the valve enables the reduction or even the avoidance of the off-ratio between components to be dispensed increasing the mixing quality. Due to the presence of the valve one can also avoid a negative pressure from arising in the outlet passages which could possibly lead to cross contamination between the materials stored in the cartridge.

Further benefits and advantageous embodiments of the invention will become apparent from the description and from the accompanying drawings.

The valve can be an injection molded valve that is, in particular formed from, especially only, one composition, such as TPE, and preferably comprises one polymer or polymer blend. For example the valve can be made of several substances, such as a plastic, e.g. TPE, that can include additives, polar groups and/or primers. Such valves can be produced in a cost effective and facile manner.

The valve can be opened if a pre-determinable pressure is applied on the valve and can be closed if a pressure less than the pre-determinable pressure is applied to the valve, in particular wherein the pre-determinable pressure is selected in the range of 1.1 to 60 bar, especially within 1.2 to 55 bar, most especially within 10 to 50 bar. Forming a valve such that it opens and closes above and below specific thresholds ensures that the valve is closed if no desired pressure is applied on the multi-component material and also if the multi-component material is still slightly pressurized following a dispensing procedure.

The valve can be arranged at an inlet end of the respective outlet passage that is remote from an outlet opening of the outlet passage, in particular wherein the valve can be arranged at an axial height of the passage with respect to an inlet opening of the respective outlet passage that amounts to 3 to 20% of a length of the outlet passage. Forming the valve in this position ensures a facile method of manufacture and also ensures that a front-filling of the cartridge is possible.

The valve can be arranged at an outlet end of the respective outlet passage that is remote from an inlet opening of the outlet passage, in particular wherein the valve can be arranged at an axial height of the outlet passage with respect to an outlet opening of the respective outlet passage that amounts to 80 to 97% of a length of the outlet passage.

Alternatively the valve can be arranged between an inlet opening of the respective outlet passage and an outlet opening of the outlet passage, in particular wherein the valve is arranged at an axial height of the outlet passage with respect to an inlet opening of the respective outlet passage that amounts to 20 to 80%, in particular 40 to 60% of a length of the outlet passage. Such axial positions can be selected to aid the manufacture of the head part and/or to influence the function of the valve.

The shape of the valve can be one of flat or at least substantially flat, deformed, convex in the direction of an outlet opening of the outlet or concave in the direction of the outlet opening of the outlet. Such valves are simple to form in a reproducible and cost-effective manner.

The valve can have a planar portion or an at least substantially planar portion, with the planar portion comprising one or more slits, preferably 1 to 18 slits, these can be line shaped, cross-shaped or star shaped slits. Forming slits within the valve ensures that the valve can function in a manner similar to e.g. the mitral valve of the heart and ensure the flow of a liquid through the valve only if a pressure is exerted on the valve.

The valve can be disposed in the outlet passage after the cartridge has been formed, for example, by a press fit or an interference fit. In this way a valve could either be retrofitted into existing cartridges where the presence of a valve was not envisaged. Moreover, a manufacturer of the materials to be stored in a cartridge can retrofit the cartridges with a valve only for certain materials e.g. if a material with a particularly low viscosity is to be stored in the cartridge.

Alternatively the head part can be overmolded around parts of the valve, in particular around a peripheral portion of the valve. In this way the valve can be present in the injection mold as part of the cartridge, this enables an even more facile and cost effective manufacture of a cartridge with a valve.

The valve can be made from a material having a hardness measured with the Shore A Durometer selected in the range of 20A to 90A. In this way the valve is made from a comparatively soft thermoplastic elastomer (TPE) and can be produced in a cost effective and reproducible manner.

The head part can be made from a material having a hardness measured with the Shore D Durometer selected in the range of 55D to 100D. In this way the cartridge is made from a comparatively hard thermoplastic elastomer, such as PE or PP and can be produced in a cost effective and reproducible manner.

The material of the head part is typically selected such that a bond is formed between the head part and the material of the valve that is in direct contact with the head part. The bond between the valve and the head part is generally selected such that the valve does not tear off from the head part during a filling of the cartridge or a dispensing from the cartridge. In this connection it should be noted that during a dispensing process pressures in the range of 10 to 50 bar can be exerted onto this bond due to the pressure exerted on the material stored within the cartridge by the piston, i.e. the bond should be able to withhold a pressure exerted by the materials stored in the cartridge on dispensing from the cartridge and/or on filling the cartridge.

A material of the head part can have a hardness that is greater than a hardness of a material of the valve. In this way a softer component is used to seal a comparatively hard component and due to the difference in hardness one can ensure that the valve will close correctly. In this connection it should be noted that the material will only be dispensed via the valve.

The thickness of the valve can be selected in the range of 0.25 to 1.5 mm, in particular of 0.4 to 1 mm. Such thicknesses provide a valve that can be produced in a facile and cost-effective manner. These thicknesses moreover provide a good trade off between retaining properties and the discharge force required to dispense the material stored in the cartridge.

The cartridge wall can be formed by a flexible film bag. Alternatively, the cartridge wall provide be formed in one piece with the head part, in particular from the same material as the head part. In this way all kinds of cartridges could be used in conjunction with the valve presented herein.

The cartridge can be filled with an adhesive material or a coating material. The multi-component cartridge can thus be used in a plethora of fields of application ranging from industrial applications, such as the use of adhesives to bond structural components one to another, or as coatings for buildings or vehicles, to medical and dental applications, for example, to make dental molds.

The multi-component material stored in the cartridge can, for example, be a two-component adhesive comprising a filler material and a hardener.

Alternatively the fluids and hence the dispensing assembly can also be used in an industrial sector both for the production of products as well as for the repair and maintenance of existing products, e.g. in the building industry, the automotive industry, the aerospace industry, in the energy sector, e.g. for windturbines, etc. The dispensing assembly can, for example, be used for the dispensing of construction material, sealants, bonding material, adhesives, paints, coatings and/or protective coatings.

The cartridge can be a two-component cartridge and the valve can be arranged in one only or a respective valve can be arranged in both of the outlet passages of the two-component cartridge, wherein, in particular if two valves are provided, these are either of identical design or differ in their design.

For materials with big differences e.g. in the viscosity of the respective material for example, a valve with different contours (e.g. flat on one side, contour on the other side), different wall thickness (0.5 mm on one side, 1 mm on the other side), different amount of slits in the valve or with a valve on one side and no valve on the other side could also be used to aid in the control of the flow behavior of the material stored in the valve. The aim is to minimize and preferably avoid an off-ratio between the materials stored in the cartridge on a dispensing thereof to improve the mixing quality of the materials to be mixed.

In this connection it should further be noted that the valves described herein can be used in a plurality of different types of cartridges, for example, one or multi-component cartridges. If e.g. a two-component cartridge is used this can be formed as a side-by-side cartridge, a coaxial cartridge or a cartridge formed by joining two single components cartridges e.g. by a "click together" process such as a snap-fit connection or the like.

A further aspect of the present invention relates to a method of making a cartridge, in particular as described herein, the cartridge comprising a head part having an outlet, wherein the outlet has one, two or more outlet passages formed therein, wherein a valve is provided in each one of the one, two or more outlet passages, the method comprising the steps of:

providing the valve(s) in an injection mold; and injection molding the head part around parts of the valve(s) to axially and radially fix the valve to the head part while integrally forming said head part to a cartridge wall. In this way, a cartridge having the advantages discussed in the foregoing can be made available in a cost effective facile and reproducible manner.

The step of providing the valve can further comprise the step of injection molding the valve in situ prior to injection molding the head part around the valve, in particular wherein the valve is injection molded from a material different from that of the head part. In this way the cost of manufacture of such cartridges can be further reduced.

A further aspect of the present invention relates to a method of making a cartridge, in particular a cartridge as described herein, the cartridge comprising a head part having an outlet, the head part being integrally formed with a cartridge wall, wherein the outlet has one, two or more outlet passages formed therein, wherein a valve is disposed in each one of the one, two or more outlet passages, the method comprising the steps of:

providing the head part;

inserting the valve(s) into the outlet passage(s) of the head part, wherein the valve is preferably present as an insert; and fixing the valve(s) in the outlet passage(s) in an axial and radial position.

In this way a cartridge having the advantages discussed in the foregoing can be made available in a cost effective facile and reproducible manner.

A further aspect of the present invention relates to a method of using a cartridge, preferably a cartridge as described herein, wherein the cartridge is filled with a multi-component material, the method comprising the steps of:

dispensing a portion of the multi-component material via the outlet by applying a pressure on the multi-component material;

releasing the pressure on the multi-component material; and sealing the outlet with the valve to prevent multi-component material from exiting the outlet if a pressure is applied to the multi-component material that is below a pre-determinable pressure. When conducting such a method of use of a cartridge one can avoid multi-component material from exiting the cartridge in an unwanted manner.

BRIEF DESCRIPTION OF DRAWINGS

The invention will be explained in more detail hereinafter with reference to the drawings.

DETAILED DESCRIPTION

Figure 1:
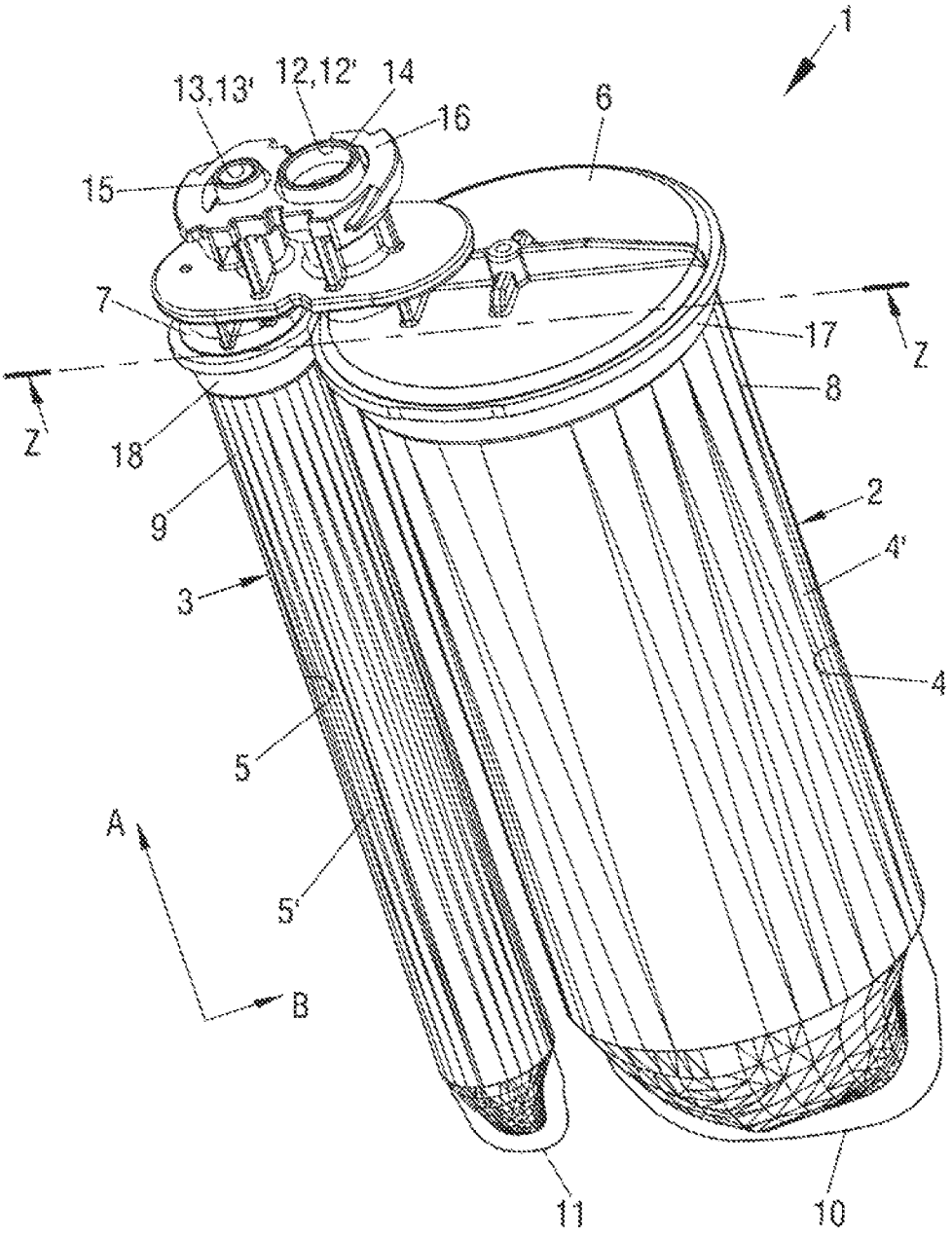
FIG. 1 is a perspective view of a cartridge.

In the following the same reference numerals will be used for parts having the same or equivalent function. Any statements made having regard to the direction of a component are made relative to the position shown in the drawing and can naturally vary in the actual position of application.

FIG. 1 shows a cartridge 1 configured as a two-component cartridge. The cartridge 1 comprises two generally cylindrical cartridge chambers 2, 3. The cartridge chambers 2, 3 are each bound by a cartridge wall 4, 5 as well as by a head part 6, 7, with each head part 6, 7 being arranged at a respective front end 8, 9 of the cartridge wall 4, 5. Each cartridge wall 4, 5 extends in a longitudinal direction A of the cartridge 1 from a respective rear end 10, 11 to the respective front end 8, 9.

Each head part 6, 7 is a stable shaped part of generally plate-like shape and comprises respective dispensing outlets 12, 13 having outlet openings 12', 13' via which a respective medium (not shown) can be dispensed from the cartridge chambers 2, 3. The two dispensing outlets 12, 13 extend from the head parts 6, 7 as outlet passages 14, 15 through a common outlet 16. A mixing tip or closure part (each not shown) can be connected to the common outlet 16.

Each head part 6, 7 has a collar 17, 18, with each collar 17, 18 surrounding the dispensing outlet 12, 13 in a radially outer region of the head part 6, 7. A radial direction B is indicated relative to the arrow A used to identify the longitudinal direction A. Each collar 17, 18 has a length extending in the longitudinal direction A. The front end 8, 9 of each cartridge wall 4, 5 is sealingly and non-releasably connected to the collar 17, 18 of the head part 6, 7.

When using the cartridges 1 that have cartridge walls 4, 5 formed from a film 4', 5', the film bags are inserted into sleeves (not shown) and a piston (not shown) is inserted into the sleeve together with the film bag in order to actuate the film bag and dispense the multi-component material in a manner known per se.

The cartridge walls 4, 5 are each formed from a film 4', 5'. Each rear end 10, 11 of the cartridge walls 4, 5, formed from the film 4', 5', is welded shut in a sealing manner in the present example to form a film bag.

It should be noted in this connection that the cartridge walls 4, 5 could also be formed in one piece with each head part 6, 7 from the same material as the head part 6, 7 (not shown). The cartridge walls 4, 5 would then be adapted to permit movement of a piston (also not shown) within the cartridge walls 4, 5 in order to dispense the multi-component material.

It should further be noted in this connection that the film 4', 5' forming the cartridge walls 4, 5 can be a multilayer film having at least two layers formed from different materials. Such multi-layer films are used e.g. when particularly aggressive substances are stored in the cartridge 1.

It should also be noted that the film 4', 5', regardless of whether it is a film made from one type of material or a multilayered film made from one or more different types of materials, can have a thickness of at most 0.3 mm, more specifically of at most 0.15 mm, preferably of approximately 0.085 mm.

Figure 2A:
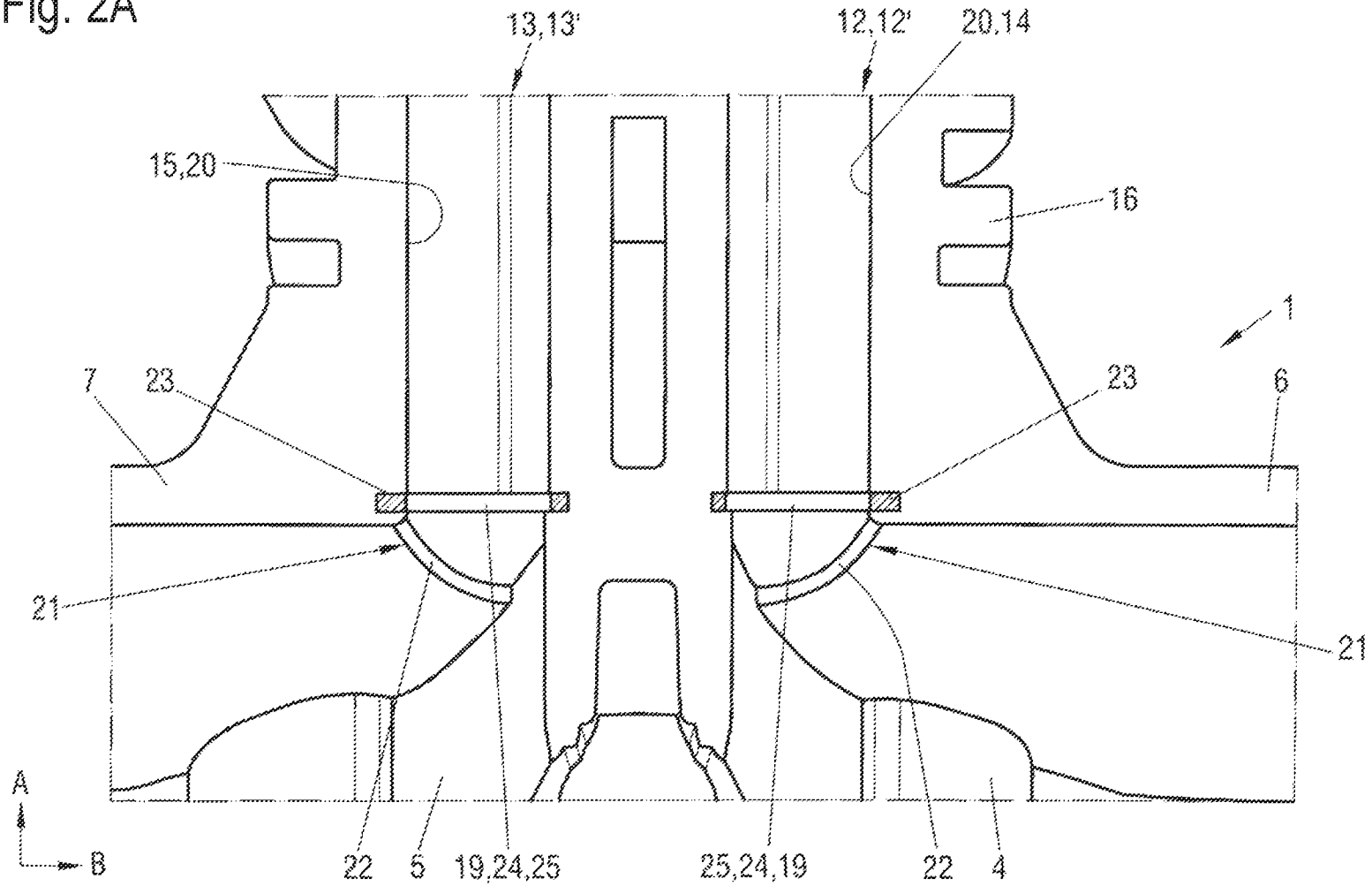
FIGS. 2A to 2E are cross-sectional views through the head parts of cartridges showing different kinds of valves arranged therein.

FIG. 2A shows a cross-sectional view through the head parts 6, 7 of the cartridge 1 showing a first kind of valve 19 arranged in each of the outlet passages 20 of the respective dispensing outlet 12, 13. The outlet passages 20 extend in parallel to the longitudinal direction A of the cartridge 1.

The valve 19 is arranged at an inlet end 21 of the respective outlet passage 20 that is remote from the outlet opening 12', 13' of the dispensing outlet 12, 13. More specifically the valve is arranged at an axial height of the passage with respect to an inlet opening 22 of the respective outlet passage 20 that amounts to 3 to 20% of a length of the outlet passage 20.

The length of the outlet passage 20 is defined as the length between a corresponding inlet opening 22 and the respective outlet opening 12', 13' associated therewith.

The valve 19 is an injection molded valve that is formed from only one material. On attaching the valve 19 to the respective outlet passage 20 the valve 19 is axially and radially fixed in position relative to the respective head part 6, 7 at a peripheral portion 23 of the valve 19.

The valve 19 is opened if a pre-determinable pressure is applied to the valve 19 and is closed if a pressure less than the pre-determinable pressure is applied to the valve 19, in particular wherein the pre-determinable pressure is selected in the range of 1.1 to 60 bar, especially within 1.5 to 55 bar most especially 10 to 50 bar.

The first kind of valve 19 shown in FIG. 2A is a flat planar valve 19. As is also indicated e.g. in FIG. 4A, the planar valve 19 comprises flaps 24 that are separated by one or more slits 26 (see FIG. 4A). In this way the valve 19 can function in a manner similar to a mitral valve on dispensing multi-component material from the cartridge 1.

Figure 2B:
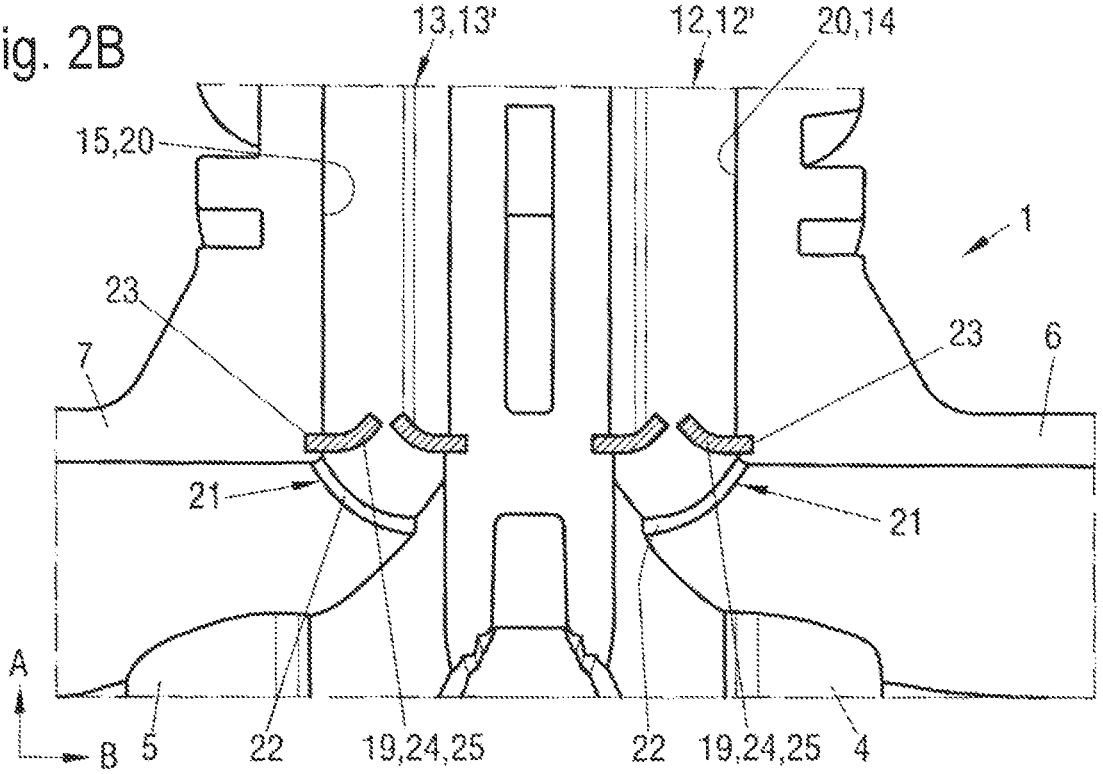
Figure 2C:
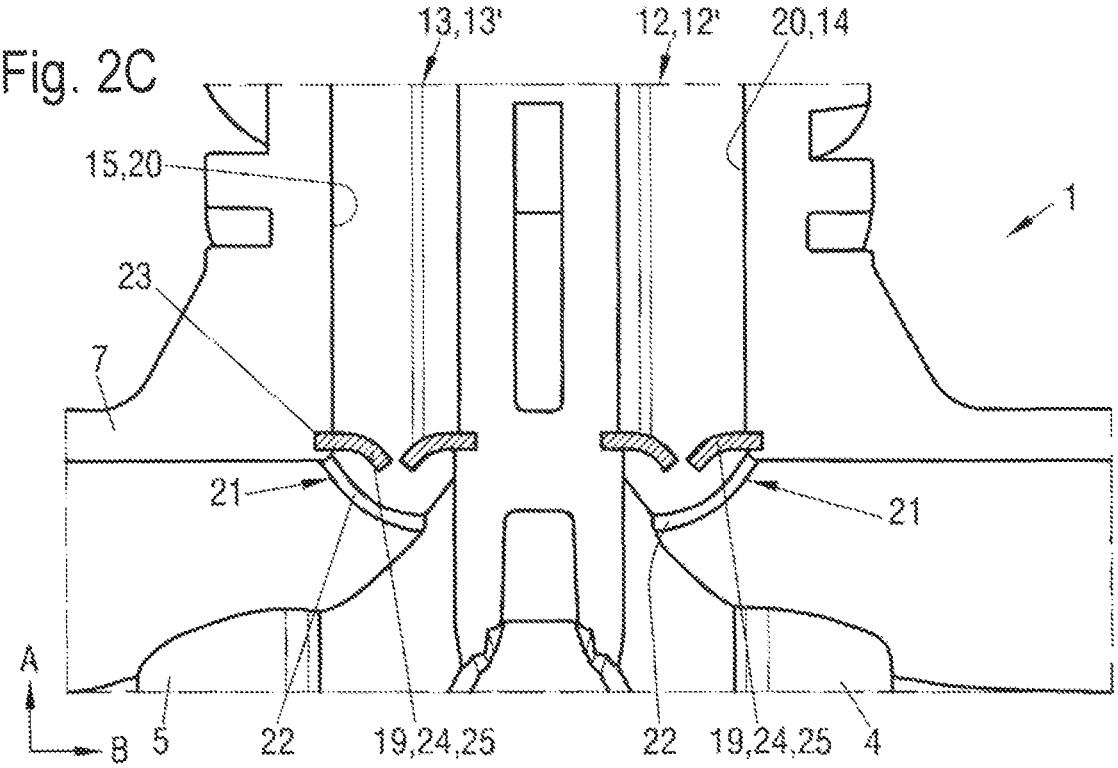

FIGS. 2B and 2C show cross-sectional views similar to FIG. 2A, with the valve 19 respectively being open. FIG. 2B in this connection shows how the flaps 24 of the valves 19 are deflected in the longitudinal direction A towards the outlet opening 12', 13' of the common outlet 16. This is the shape the flaps 24 of the valves 19 adopt during a dispensing process. After dispensing, pressure on the material is removed permitting the flaps 24 to adopt the position shown in FIG. 2A and thereby preventing further material from flowing out of the chambers 4, 5 and hence from exiting the outlets 12, 13 which could cause cross contamination at the outlets 12, 13.

FIG. 2C in this connection shows how the flaps 24 of the valves 19 are deflected in the longitudinal direction A away from the outlet opening 12', 13' of the common outlet 16. This is the shape the flaps 24 of the valves 19 adopt during a filling process. After the filling process is completed a filling nozzle (not shown) which permits the flaps 24 to adopt the position shown in FIG. 2A. When closing, the flaps scrape off any material that may be present at the end of the filling nozzle and thereby also aid in the avoidance of cross-contamination.

Figure 2D:
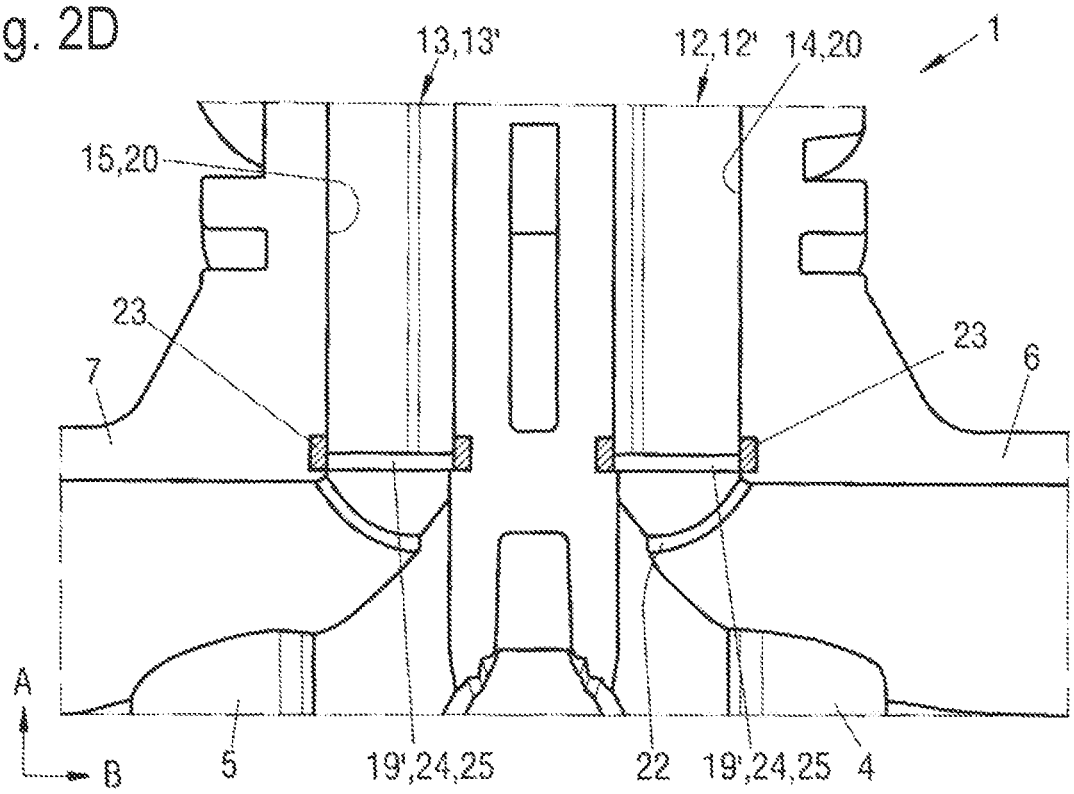
Figure 2E:
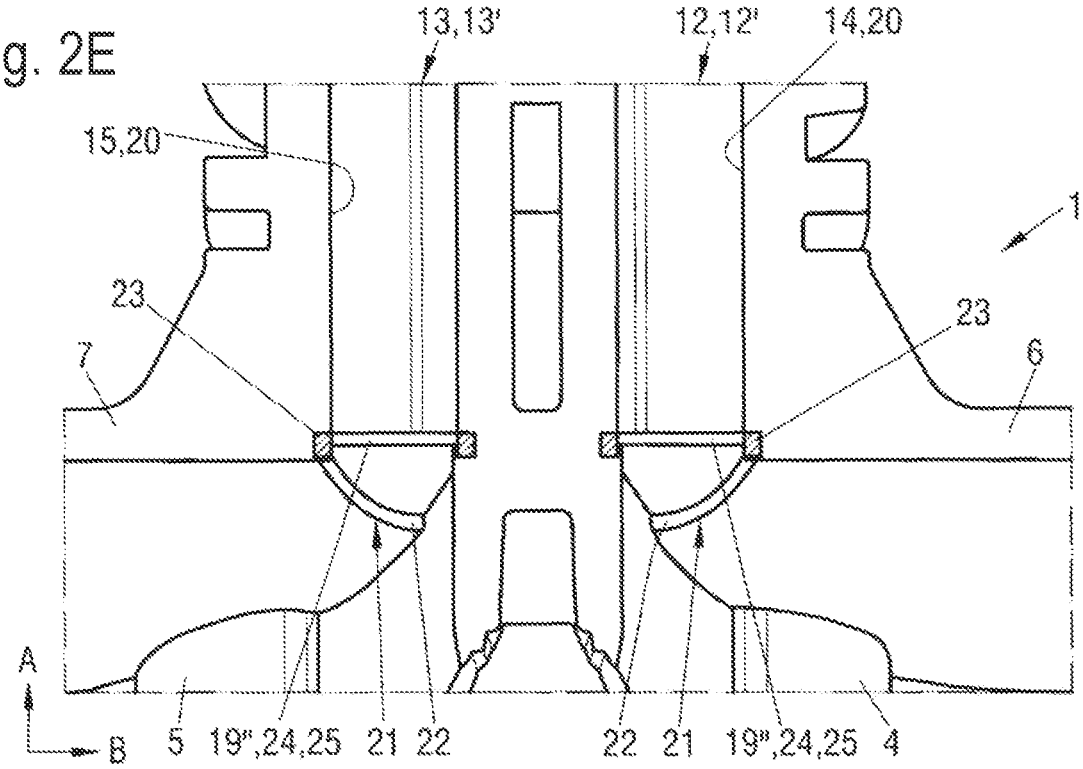

FIGS. 2D and 2E show cross-sectional views similar to FIG. 2A of further kinds of valves 19', 19". In FIG. 2D the peripheral portion 23 of the valve 19' is wider than the planar portion 25 and projects beyond the planar portion 25 of the valve 19' in the longitudinal direction A toward the outlet opening 12', 13' of the common outlet 16. In FIG. 2E the peripheral portion 23 of the valve 19" is also wider than the planar portion 25 and projects beyond the planar portion 25 of the valve 19' in the longitudinal direction A away from the outlet opening 12', 13' of the common outlet 16.

In this connection it should further be noted that the peripheral portion 23 can also be formed such that it projects beyond the planar portion 25 of the valve 19' on both sides of the valve 19'. The different shaped designs of the peripheral portion 23 are selected such that the attachment of the valve 19, 19', 19" to the head part 6, 7 can be further enhanced in dependence on the viscosity of the material stored in the cartridge 1.

Figure 3A:
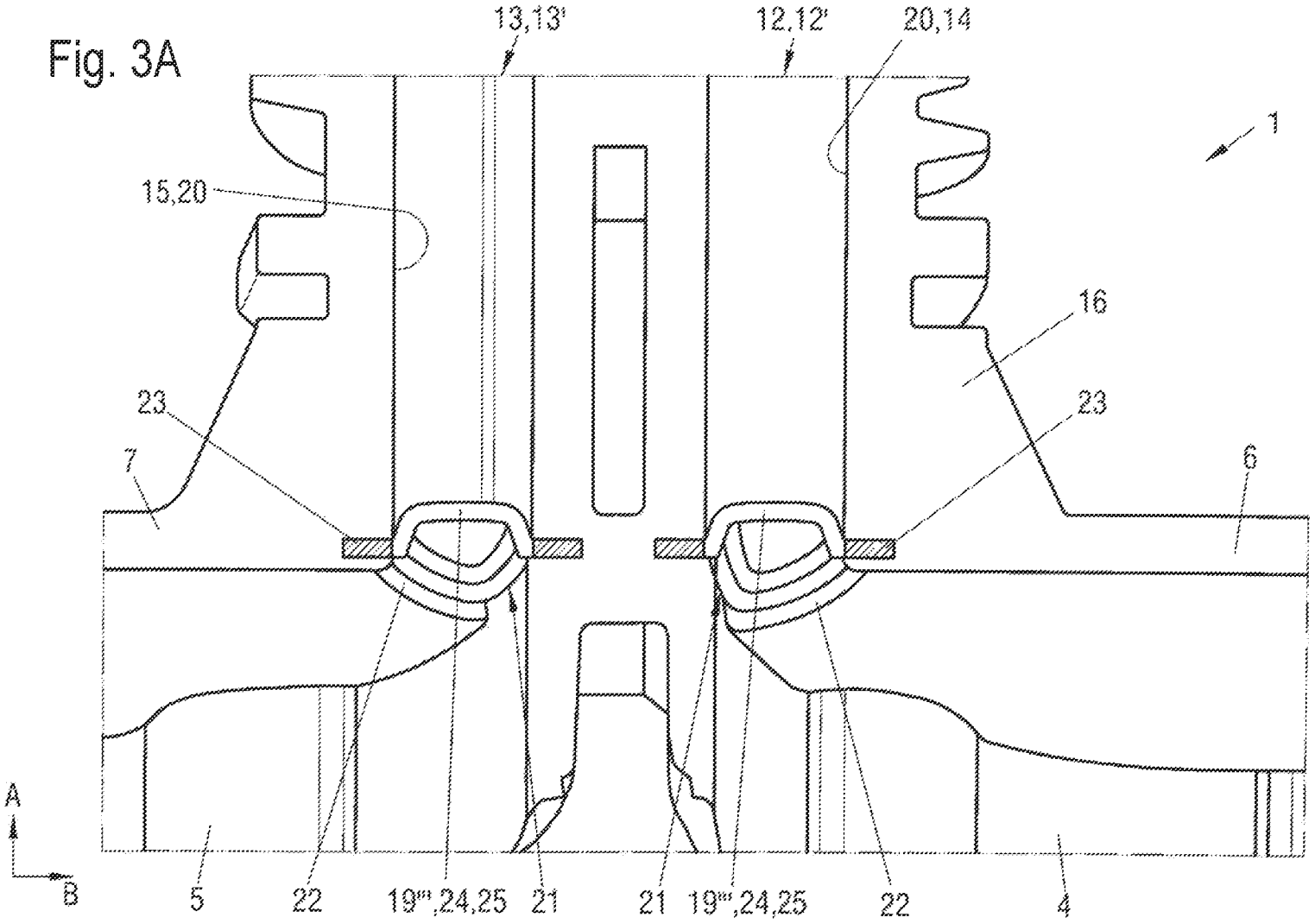
FIGS. 3A to 3C are cross-sectional views through the head parts of a cartridge showing a further kind of valve arranged therein, with the valves being closed (FIG. 3A) and open (FIGS. 3B and 3C)

FIG. 3A shows a cross-sectional view through the head parts 6, 7 of the cartridge 1 showing a further kind of valve 19'" arranged therein. The valve 19'" is deformed in comparison to that shown in FIG. 2A. In particular the valve 19'" is shaped as convex in the direction of the outlet opening 12', 13' of the common outlet 16.

The convex shaped valve 19'" also has a planar portion 25 like the valve 19 shown in FIG. 2A. The planar portion 25 comprises one or more slits, preferably 1 to 18 slits, and as indicated in FIG. 4B can comprise four flaps 24 separated by two such slits 26.

Figure 3B:
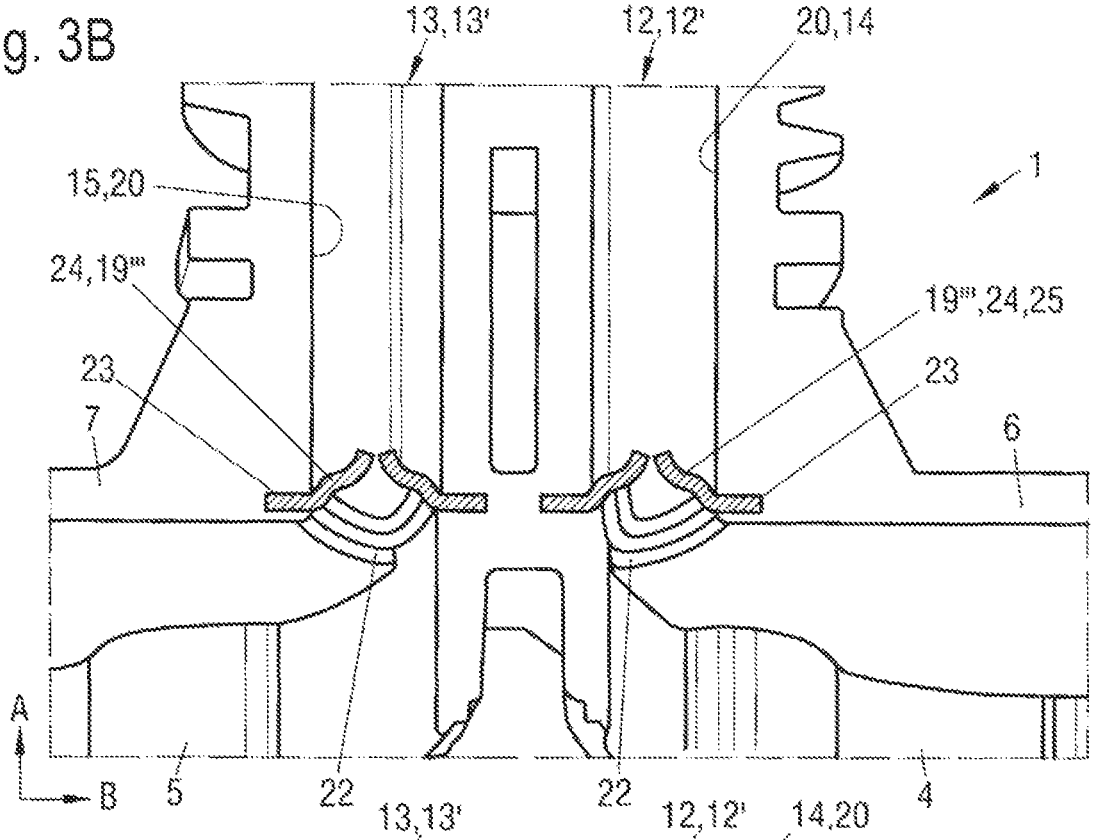
Figure 3C:
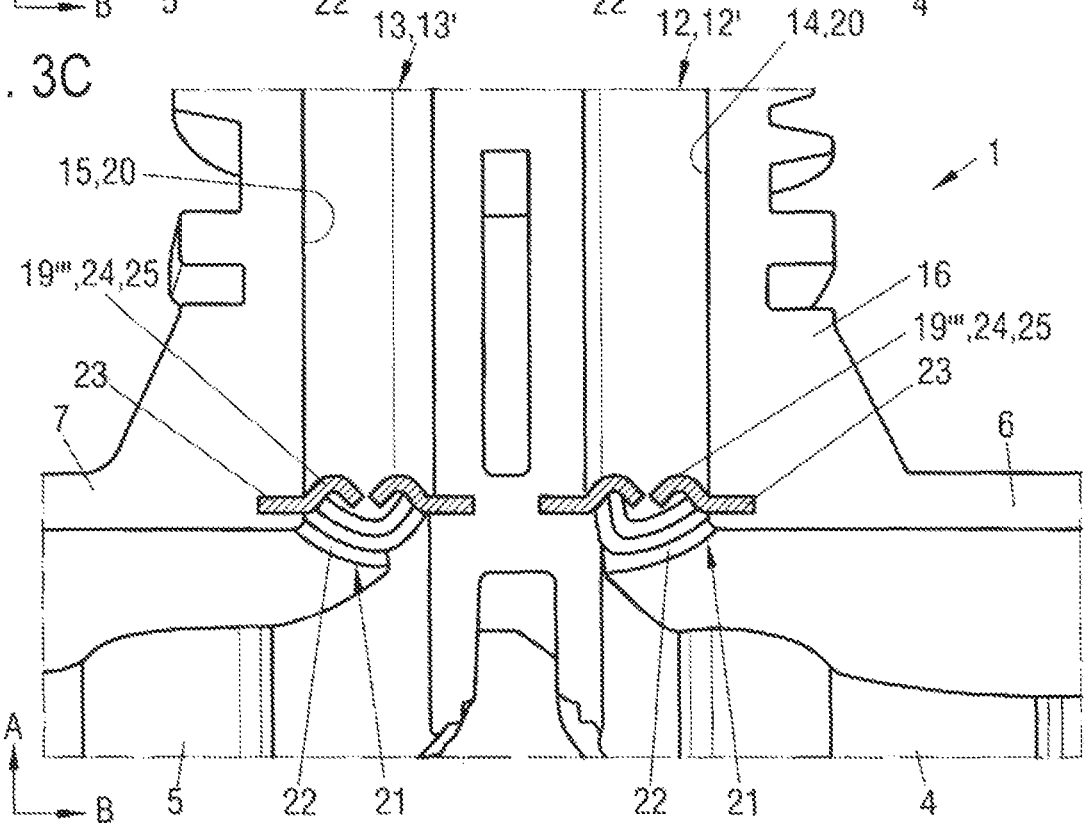

FIGS. 3B and 3C show cross-sectional views similar to FIG. 3A, with the valve 19'" respectively being open. FIG. 3B in this connection shows how the flaps 24 of the valves 19'" are deflected in the longitudinal direction A towards the outlet opening 12', 13' of the common outlet 16. This is the shape the flaps 24 of the valves 19'" adopt during a dispensing process.

FIG. 3C in this connection shows how the flaps 24 of the valves 19'" are deflected in the longitudinal direction A away from the outlet opening 12', 13' of the common outlet 16. This is the shape the flaps 24 of the valves 19'" adopt during a filling process.

In this connection it should be noted that the peripheral portion 23 of the valve 19'" could be adapted in a manner similar to that shown and discussed in connection with FIGS. 2D and 2E.

Figure 4A:
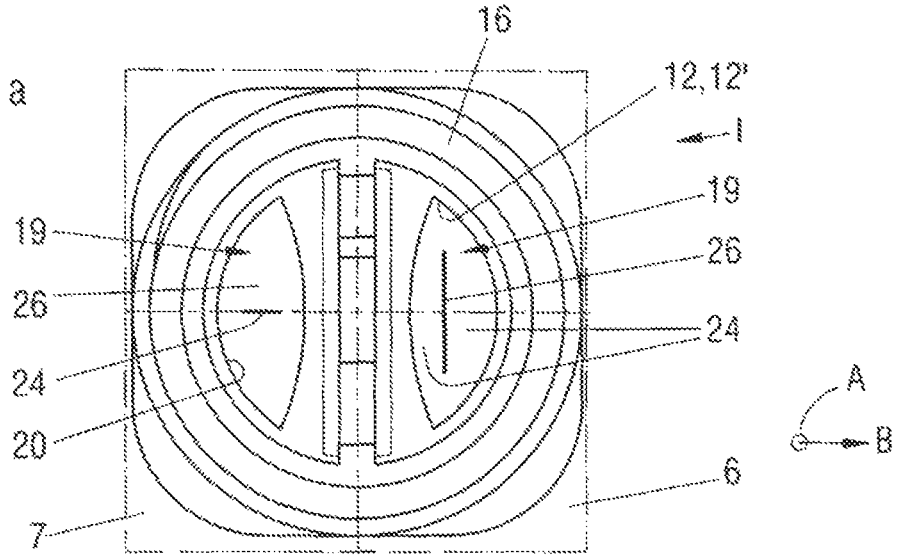
FIGS. 4A to 4C are top views of different valves present in a respective head part.
Figure 4B:
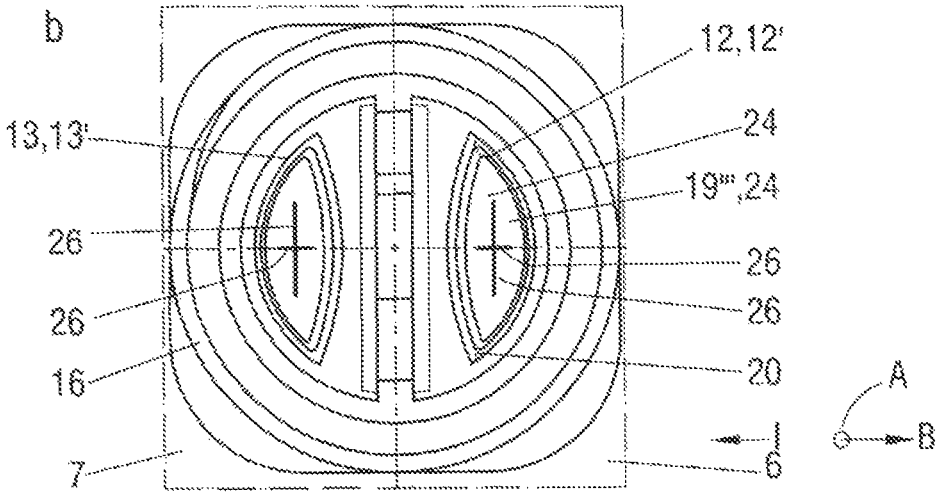
Figure 4C:
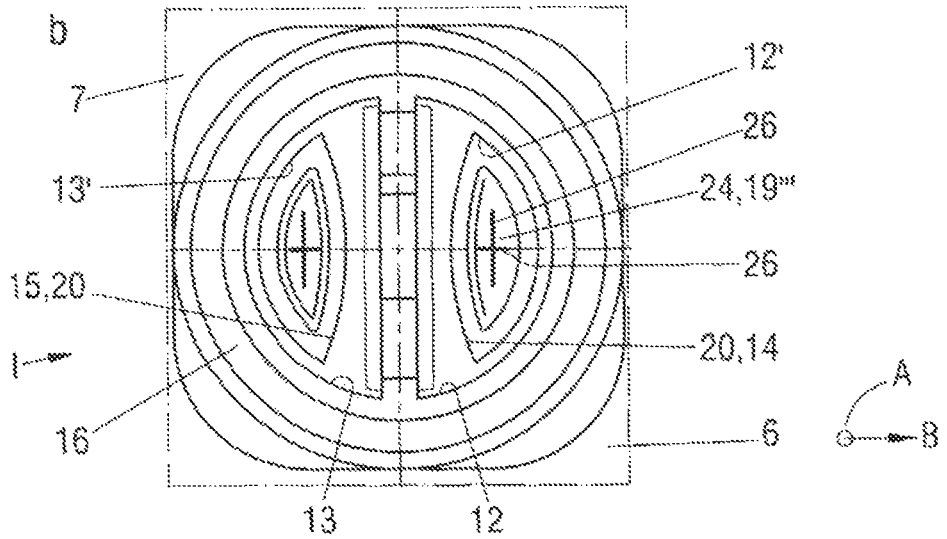

FIGS. 4A to 4C show top views of different valves 19, 19'", 19"" inserted into a respective common outlet 16. In FIG. 4A the valve 19 is a planar valve composed of two flaps 24 that are separated by one slit 26.

The valve 19'" in FIG. 4B has a convex shape in the direction of the outlet opening 12', 13' of the common outlet 16. The valve 19'" comprises four flaps 24 that are separated by two slits 26.

The valve 19'''' in FIG. 4C is shaped as concave in the direction of the outlet opening 12', 13' of the common outlet 16. The valve 19'''' comprises four flaps 24 that are separated by two slits 26.

In each embodiment, the valve 19, 19', 19'', 19''', 19'''' is axially and radially fixed in position within the respective outlet passage 20. The valve only comprises its flaps 24 as moveable parts, but the remainder of the valve 19, 19', 19'', 19''', 19'''' is fixed in its position.

In the drawings of FIGS. 2A to 4C, the respective head part 6, 7 is overmolded around parts of the valve, in particular around the peripheral portion 23 of the valve 19, 19', 19'', 19''', 19''''.

The valves 19, 19', 19'', 19''', 19'''' discussed in the foregoing can be made from a material having a hardness measured with the Shore A Durometer selected in the range of 20A to 90A.

Moreover, the respective head part 6, 7 and the common outlet 16 can be made from a material having a hardness measured with the Shore D Durometer selected in the range of 55D to 100D.

A thickness of the respective valve 19, 19', 19'', 19''', 19'''' can be selected in the range of 0.25 to 1.5 mm, in particular of 0.4 to 1 mm.

The cartridge 1 can be made in an injection molding process in which the valve 19, 19', 19'', 19''', 19'''' is either provided prior to or after injection molding the head parts 6, 7. Optionally the valve 19, 19', 19'', 19''', 19'''' can be injection molded in situ prior to injection molding the head part 6, 7 around the valve 19, 19', 19'', 19''', 19''''. In this connection it should be noted that the valve can be made from a material different from that of the head part 6, 7.

When using the cartridge 1 with such a valve 19, 19', 19'', 19''', 19'''', the cartridge 1 is filled with a multi-component material, and the method of using the cartridge 1 comprises the steps of dispensing a portion of the multi-component material via the outlet 16 by applying a pressure to the multi-component material; releasing the pressure on the multi-component material; and sealing the outlet 16 by the valve 19, 19', 19'', 19''', 19'''' to prevent multi-component material from exiting the outlet 16 if a pressure is applied on the multi-component material that is below a pre-determinable pressure.

The valve 19, 19', 19'', 19''', 19'''' can generally be used to control the pressure present within the cartridge 1 and the outlet passage 14, 15, 20 both on filling the cartridge chamber 2, 3 and when dispensing from the cartridge chamber 2, 3. For a two-component cartridge it is namely desirable if the materials dispensed from the cartridge exit the cartridge at the same time in order to prevent a so-called off-ratio from arising. This off ratio is due to the less viscous of the two materials from exiting the cartridge 1 before the other component exits, this is particularly the case if there is a large difference between the viscosities of the materials to be mixed. Such an off ratio leads to a faulty mixing ratio and hence the presence of the valves 19, 19', 19'', 19''', 19'''' in the outlet passages 14, 15, 20 enables the faster, i.e. the less viscous, of the materials to be slowed down in comparison to the other material, in order to achieve improved mixing results.

The invention claimed is:

1. A cartridge configured for use with adhesives or coatings, the cartridge comprising:

a head part having an outlet, the head part being integrally formed with a cartridge wall, and the outlet having one, or more outlet passages formed therein that extend in parallel to a longitudinal direction of the cartridge; and a valve arranged at an inlet end of at least one of the one or more outlet passages, with the valve being axially and radially fixed in position relative to the longitudinal direction and the head part at a peripheral portion of the valve and remote from an outlet opening of the least one of the one or more outlet passages.

2. The cartridge in accordance with claim 1, wherein the valve is an injection molded valve.

3. The cartridge in accordance with claim 2, wherein the valve is an injection molded valve that is formed from one composition.

4. The cartridge in accordance with claim 3, wherein the one composition includes one polymer or polymer blend.

5. The cartridge in accordance with claim 1, wherein the valve is opened when a pre-determinable pressure is applied to the valve and is closed when a pressure less than the pre-determinable pressure is applied to the valve.

6. The cartridge in accordance with claim 5, wherein the pre-determinable pressure is selected in the range of 1.2 to 60 bar.

7. The cartridge in accordance with claim 1, wherein the valve is arranged between an inlet opening of the least one of the one or more outlet passages and an outlet opening of the least one of the one or more outlet passages.

8. The cartridge in accordance with claim 7, wherein the valve is arranged at an outlet end of the respective outlet passage that is remote from an inlet opening of the outlet passage.

9. The cartridge in accordance with claim 7, wherein the valve is arranged at an axial height of an axial length of the least one of the one or more outlet passages with respect to the inlet opening of the least one of the one or more respective outlet passages that amounts to 20% of a length of the least one of the one or more outlet passages, the axial length of the least one of the one or more outlet passages being defined from the inlet opening to the outlet opening.

10. The cartridge in accordance with claim 1, wherein the valve is arranged at an axial height of an axial length of the least one of the one or more outlet passages with respect to the inlet opening of the least one of the one or more outlet passages that amounts to 3 to 20% of a length of the least one of the one or more outlet passages, the axial length of the least one of the one or more outlet passages being defined from the inlet opening to the outlet opening.

11. The cartridge in accordance with claim 1, wherein a shape of the valve is one of flat or at least substantially flat, deformed, convex in a direction of an outlet opening of the least one of the one or more outlet passages or concave in a direction of the outlet opening of the least one of the one or more outlet passages, at least in a cross-section perpendicular to the longitudinal direction.

12. The cartridge in accordance with claim 1, wherein the valve has a planar portion or an at least a substantially planar portion, with the planar portion comprising one or more slits extending through the planar portion in the axial direction.

13. The cartridge in accordance with claim 1, wherein the valve is disposed in the least one of the one or more outlet passages after the cartridge has been formed.

14. The cartridge in accordance with claim 1, wherein the head part is overmolded around parts of the valve.

15. The cartridge in accordance with claim 1, wherein the valve is made from a material having a hardness measured with the Shore A Durometer selected in a range of 20A to 90A; or the head part is made from a material having a hardness measured with the Shore D Durometer selected in the range of 55D to 100D; or the valve is a thermoplastic elastomer; or a material of the head part has a hardness that is greater than a hardness of a material of the valve.

16. The cartridge in accordance with claim 1, wherein the cartridge wall is formed by a flexible film bag.

17. The cartridge in accordance with claim 1, wherein the cartridge wall is formed in one piece with the head part.

18. The cartridge in accordance with claim 17, wherein the cartridge wall is formed in one piece with the head part and from the same material as the head part.

19. The cartridge in accordance with claim 1, wherein the cartridge is filled with an adhesive material or a coating material.

20. The cartridge in accordance with claim 1, wherein the cartridge is a two-component cartridge and the least one of the one or more outlet passages includes first and second outlet passages, and the valve is arranged in only one of the first and second outlet passages or the valve is one of first and second valves and the first and second valves are respectively disposed in the first and second outlet passages of the cartridge.

21. The cartridge in accordance with claim 20, wherein the first and second valves are either identical in design or differ in design.

22. A method of making the cartridge in accordance with claim 1, the method comprising:

providing the valve in an injection mold; and injection molding the head part around parts of the valve to axially and radially fix the valve to the head part while integrally forming the head part to the cartridge wall.

23. The method according to claim 22, wherein the providing the valve comprises injection molding the valve in situ prior to the injection molding the head part around the valve.

24. The method according to claim 23, wherein the valve is injection molded from a material different from that of the head part.

25. A method of making the cartridge in accordance with claim 1, the method comprising:

providing the head part;

inserting the valve into the at least one of the one or more outlet passages of the head part; and fixing the valve in the at least one of the one or more outlet passages in an axial and radial position.

26. A method of operating the cartridge in accordance with claim 1, the cartridge filled with a multi-component material, the method comprising:

dispensing a portion of the multi-component material via the at least one of the one or more outlet passages by applying a pressure on the multi-component material;

releasing the pressure on the multi-component material; and sealing the outlet with the valve to prevent multi-component material from exiting the outlet when pressure is applied to the multi-component material that is below a pre-determinable pressure.

27. The cartridge in accordance with claim 1, wherein a thickness of the valve is selected in a range of 0.25 to 1.5 mm.

28. The cartridge in accordance with claim 1, wherein a thickness of the valve is selected in a range of 0.4 to 1 mm.

* * * * *